United States Patent [19]

West et al.

[11] Patent Number: 4,551,871

[45] Date of Patent: Nov. 12, 1985

[54] INFANT PROTECTING COMMODE INSERT

[76] Inventors: Jerry D. West, 702 E. 19, Stillwater, Okla. 74074; Wayne W. Vinson, 919 N. West, Stillwater, Okla. 74075

[21] Appl. No.: 710,885

[22] Filed: Mar. 12, 1985

[51] Int. Cl.[4] ..... A47K 17/00

[52] U.S. Cl. ..... 4/661

[58] Field of Search ..... 4/661, 300.3, 666, DIG. 3, 4/253; 126/167

[56] References Cited

U.S. PATENT DOCUMENTS

| | | | |
|---|---|---|---|
| 2,803,832 | 8/1957 | Schif | 4/666 |
| 2,931,047 | 4/1960 | Stebbins | 4/300.3 |
| 3,021,528 | 2/1962 | Hargrave | 4/666 |
| 3,201,804 | 8/1965 | Masters | 4/666 X |
| 3,212,104 | 10/1965 | Stevens | 4/300.3 |

*Primary Examiner*—Henry K. Artis

*Attorney, Agent, or Firm*—Robert K. Rhea

[57] ABSTRACT

A child safety grate for the water flushed bowl of a water closet includes a generally ovate-shaped perimeter wire spanned along its major axis by parallel spaced-apart bars. Resilient members, connected with the grate, maintain it in place within a water closet bowl above the level of water therein.

6 Claims, 9 Drawing Figures

INFANT PROTECTING COMMODE INSERT

BACKGROUND OF THE INVENTION

1. Field of the Invention

The present invention relates to water closets and more particularly to a wire-like insert for the water flushed bowl to prevent a small child falling head first into water contained by the bowl.

Small children are sometimes attracted to the water contained by a water closet bowl and attempt to play in such water. This creates a hazard to the child because of their small stature and in an attempt to reach the water they sometimes topple over the edge of the bowl head first into the water and drown.

This invention provides a safety device which will effectively prevent such an accident by supporting the child above the surface of the water in a water closet bowl in the event he falls thereinto.

2. Description of the Prior Art

We are not aware of any patents disclosing any device for this purpose.

SUMMARY OF THE INVENTION

A generally ovate section of wire or rod-like material is spanned along its major axis by two or more spaced-apart lengths of the same material integrally connected thereto. Resilient rings or clips, connected with the periphery of the ovate-shape, wedge against the inner wall surface of a water closet bowl to maintain the device in a horizontal plane spaced above the surface of water therein when the device is placed in the upper limit thereof.

The principal object of this invention is to provide an insert for a water closet, or the like, which will prevent a small child falling thereinto and drowning and which will not hamper normal operation of the bowl.

DESCRIPTION OF THE PREFERRED EMBODIMENTS

Figure 2:
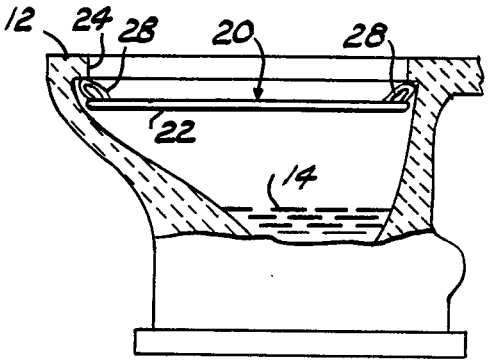
FIG. 2 is a fragmentary cross sectional view taken substantially along the line 2—2 of FIG. 1.
Figure 1:
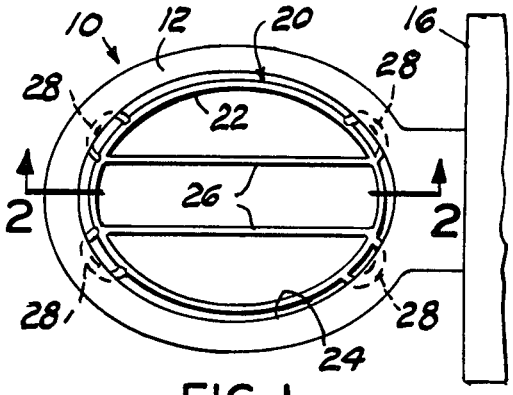
FIG. 1 is a top plan view of the preferred embodiment of the device illustrating its position relative to a water closet when installed therein.
Figure 6:
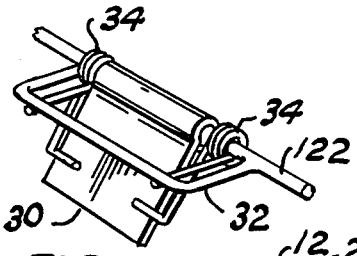
FIG. 6 is a fragmentary perspective view of one of the clips illustrated by FIGS. 3 and 4.

Like characters of reference designate like parts in those figures of the drawings in which they occur.

In the drawings:

The reference numeral 10 indicates a substantially conventional water closet bowl having an endless ring top 12 normally having an overlying seat and lid, not shown. The cavity of the bowl 10 is supplied with water from an attached reservoir or tank 16 by releasing a control valve, not shown. The bottom portion of the bowl forms a water trap to contain a quantity of water 14 within the bowl for reasons well understood in the plumbing industry. The bowl 10 and its associated components form no part of the invention other than to set forth the combination with which the invention, indicated generally by the numeral 20, is intended to be used.

The device, 20 comprises a generally planar ovate-shaped grate preferably formed from malleble rod or single strand wire material coated with a layer of plastic, or the like. The perimeter wire 22 is endless and forms the perimeter of the generally ovate-shape which preferably conforms to and is dimensioned slightly smaller than the inner wall or inner periphery 24 of the bowl rim 12 so that the rack or grate 20 may be easily inserted into the bowl. A plurality, two in the example shown, preferably straight lengths of intermediate wire bars 26 extend between and are rigidly connected at their respective ends with the perimeter wire 22 in parallel spaced-apart relation along the major axis of the ovate-shape. Obviously, one or more similar bars, not shown, may be connected along the minor axis, if desired. A plurality, four in the example shown, of resilient wire material loops 28 similarly coated with the plastic material, are connected with the perimeter wire 22 in spaced relation on either side of the major axis of the device. The size of the wire loops 28 is such that they project upwardly from the plane of the wire rack when horizontally disposed in the bowl 10 and contact the downwardly disposed limit of the bowl rim 12 so that the wire grate cannot be easily removed from the bowl by a child.

The grate 20 is removed from the toilet bowl when desired by manually springing at least two of the loops 28 out of contact with the bowl rim while simultaneously lifting that end portion of the rack.

Figure 4:
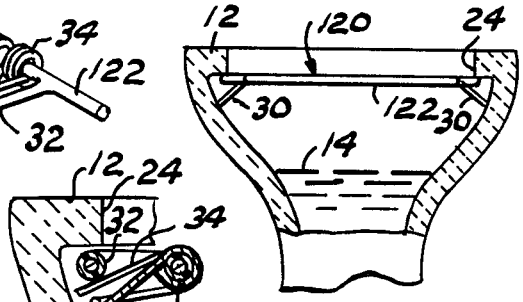
FIG. 4 is a fragmentary cross sectional view taken substantially along the line 4—4 of FIG. 3.
Figure 3:
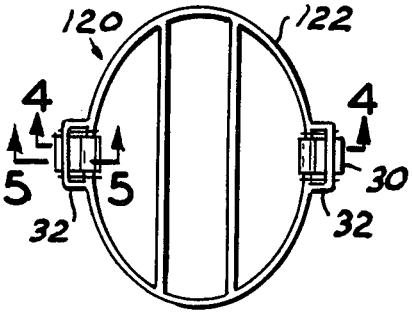
FIG. 3 is a top plan view of another embodiment of the device.
Figure 5:
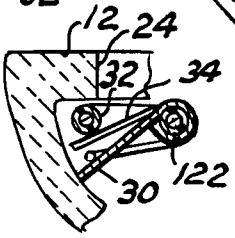
FIG. 5 is a vertical cross sectional view taken substantially along the line 5—5 of FIG. 3.
Figure 8:
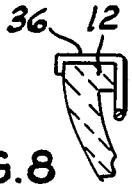
FIG. 8 is a vertical cross sectional view taken substantially along the line 8—8 of FIG. 7; and, FIG. 9 is a top plan view of a further embodiment of the device.

Referring to FIG. 3, the reference numeral 120 indicates another embodiment of the grate which is substantially identical with respect to the preferred embodiment 20 except for the toilet bowl fastening means. The loops 28 of the device 20 are omitted from this embodiment and a pair of panel clips, each comprising a planar section of material 30 having one end portion crimped around the perimeter wire 122 at the position of its minor axis. A spring loop 32 spans the respective clip 30 in the plane of the grate for receiving one end of a spring member 34 wound intermediate its ends around the perimeter rod with its end portions respectively bearing against the loop 32 and the clip 30 to bias the clip toward contact with the inner surface of the bowl 10 adjacent the undersurface of the bowl rim 12 as best illustrated by FIG. 4.

The device is inserted and removed from the bowl by manually forcing the metal clips 30 toward each other to clear the confines of the bowl rim 12.

Figure 7:
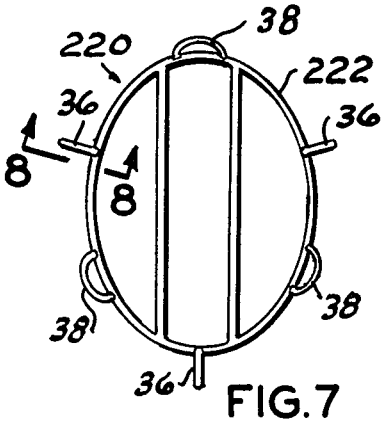
FIG. 7 is a top plan view of a another embodiment.

Referring also to FIG. 7, the reference numeral 220 indicates another embodiment of the device having a grate portion substantially identical with the preferred embodiment 20 in which a plurality of inverted L-shaped hooks 36, similarly formed from wire-like material, have their respective leg portions connected with the perimeter rod 222 in upstanding circumferentially spaced relation and overhanging at their respective foot portion the top surface of the bowl rim 12. In this embodiment, other resilient wire loops 38, similar to the spring wire loops 28, are connected with the perimeter rod in equally spaced relation to maintain the grate against unauthorized removal from the bowl 10.

Figure 9:
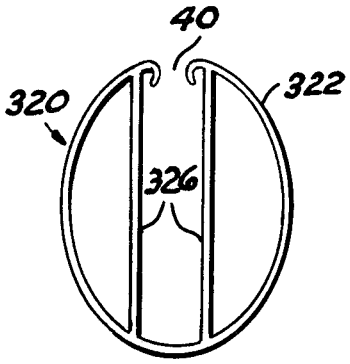

Referring also to FIG. 9, a further embodiment is indicated at 320 which substantially comprises the planar grate 20 with the spring members 28 omitted. This embodiment preferably features a split perimeter formed by cutting or dividing the perimeter wire 322 at one end of its major axis to form a blank or space 40. In this embodiment the perimeter wire 322 is biased, in opposing lateral directions, generally along its minor axis by the resilience of the wire so that the perimeter wire contacts the inner wall surface of the bowl below the rim 12 when placed therein.

The device is inserted and removed from the bowl by manually forcing the parallel bars 326 toward each other.

Obviously the invention is susceptible to changes or alterations without defeating its practicability. Therefore, we do not wish to be confined to the preferred embodiment shown in the drawings and described herein.

We claim:

1. In a water closet including a water flushed bowl having a downwardly converging inner wall surface and containing a quantity of water therein for normally closing a bottom outlet of the bowl and having an endless rim inwardly overhanging the bowl wall and defining a horizontal upper limit of the bowl spaced above the water therein, the improvement comprising:

grate means contained by the bowl adjacent its upper limit; and, resilient members secured to said grate and bearing against the inner wall surfaces of said bowl for normally preventing removal of the grate means.

2. The combination according to claim 1 in which the grate means comprises:

an endless generally ovate-shaped wire ring; and, bars spanning the ovate-shape along at least one of its axes.

3. The combination according to claim 2 in which the resilient members include:

resilient wire loops secured in outstanding spaced-apart relation to the perimeter of the ovate-shape.

4. The combination according to claim 2 in which the resilient members include:

a pair of outstanding loops respectively secured to the perimeter of the ovate-shape along its minor axis;

an elongated clip pivotally secured at one end to the ovate-shape within the limit of each outstanding loop; and, springs biasing the other end of the respective clip of said pair of clips toward the inner wall surface of said bowl.

5. The combination according to claim 2 and further including:

a plurality of hooks connected with the perimeter of the ovate-shape for supporting said grate within said bowl.

6. The combination according to claim 1 in which said grate means comprises:

a generally ovate-shaped split wire ring adapted to closely contact the inner wall surface adjacent the top rim of said bowl; and, spaced-apart parallel bars spanning the ovate-shaped ring.

* * * * *